US008009046B2

(12) United States Patent
Keays

(10) Patent No.: US 8,009,046 B2
(45) **Date of Patent: *Aug. 30, 2011**

(54) GOLF CLUB REMINDER SYSTEM FOR GOLF BAGS

(76) Inventor: Brad Keays, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/825,172

(22) Filed: Jun. 28, 2010

(65) Prior Publication Data

US 2010/0265067 A1 Oct. 21, 2010

Related U.S. Application Data

(63) Continuation of application No. 11/855,987, filed on Sep. 14, 2007, now Pat. No. 7,746,227, which is a continuation-in-part of application No. 11/667,631, filed as application No. PCT/US2005/040879 on Nov. 8, 2005, now abandoned.

(51) Int. Cl.
*G08B 13/14* (2006.01)

(52) U.S. Cl. ..... 340/568.6; 206/315.2

(58) Field of Classification Search ..... 340/568.6; 206/315.2, 315.3

See application file for complete search history.

(56) References Cited

U.S. PATENT DOCUMENTS

| | | | | |
|---|---|---|---|---|
| 5,028,909 | A | 7/1991 | Miller | |
| 5,041,779 | A | 8/1991 | Hales | |
| 5,565,845 | A | 10/1996 | Hara | |
| 5,610,585 | A | 3/1997 | Jobe | |
| 5,973,596 | A | 10/1999 | French et al. | |
| 6,023,225 | A | 2/2000 | Boley et al. | |
| 6,057,762 | A | 5/2000 | Dusza | |
| 6,118,376 | A | 9/2000 | Regester | |
| 6,366,205 | B1 | 4/2002 | Sutphen | |
| 6,696,950 | B2 | 2/2004 | Adolphson | |
| 6,774,792 | B1 | 8/2004 | Williams | |
| 7,004,848 | B2 | 2/2006 | Konow | |
| 7,022,026 | B2 | 4/2006 | Blankenship | |
| 7,106,195 | B2 | 9/2006 | Keays | |
| 7,205,894 | B1 | 4/2007 | Savage | |
| 7,746,227 | B2 * | 6/2010 | Keays | 340/568.6 |

FOREIGN PATENT DOCUMENTS

WO 2006/053188 5/2006

OTHER PUBLICATIONS

Vernier, Magnetic Field Sensor, Accessed Sep. 4, 2007, http://www.vernier.com/probes/mg-bta.html.

Honeywell, Magnetometry Solutions, Accessed Sep. 4, 2007, http://www.honeywell.com/sites/portal?smap=aerospace&page=Magnetic-Sensors3&theme=T6&catID=CE1OD0E01-15B5-6F95-60BF-ACAF71FCC2A1&id=HB08BF7D5-EBC5-00A8-AD94-BC434C762A41&sel=1&sel4=2.

* cited by examiner

*Primary Examiner* — John A Tweel, Jr.
(74) *Attorney, Agent, or Firm* — Fulwider Patton LLP

(57) ABSTRACT

The golf club reminder system for a golf bag utilizes electric, magnetic, or optical detectors to monitor golf clubs in the golf bag. A control unit is provided for determining the presence or absence of a complete set of golf clubs in the golf bag based upon golf club detection signals. A display is connected to the control unit for displaying an indication of the presence or absence of the complete set of golf clubs in the golf bag, and a user interface is connected to the control unit for setting the control unit for determining the presence or absence of the complete set of golf clubs in the golf bag.

14 Claims, 7 Drawing Sheets

GOLF CLUB REMINDER SYSTEM FOR GOLF BAGS

CROSS-REFERENCES TO RELATED APPLICATIONS

This application is a Continuation of application Ser. No. 11/855,987, filed Sep. 14, 2007, now U.S. Pat. No. 7,746,227, which is a Continuation-in-Part of application Ser. No. 11/667,631, filed May 11, 2007, which is a national phase of PCT/US2005/040879 filed Nov. 8, 2005, claiming priority from application Ser. No. 10/983,972, filed Nov. 8, 2004, now U.S. Pat. No. 7,106,195.

BACKGROUND OF THE INVENTION

1. Field of the Invention

The present invention generally relates to security systems, and more particularly relates to a golf bag and golf club security system.

2. General Background and State of the Art

As golf clubs have become more expensive and the disadvantage of losing a club such as a putter, wedge or driver during a round has become more severe, the loss or theft of golf clubs has become more and more of a problem. For example, a golfer may remove a selection of golf clubs from a golf bag to walk from a cart on a cart path to where the ball lies for a shot, lay the unused clubs down, and forget to retrieve the unused clubs after a shot is made. Whether the loss of a golf club is due to forgetfulness or outright theft, it would be desirable to provide an alarm system that would alert a player to the unauthorized removal of a golf club from the golfer's bag, or alert the player about an unnecessarily prolonged absence of a golf club from the player's bag after an authorized removal of one or more club, such as while making a shot.

In general, electrical detection of objects involves utilizing electrical and/or magnetic energy interactions between materials, and methods for detecting such electrical and/or magnetic energies can be generally divided into contact or non-contact methods. Non-contact sensing methods can be broadly categorized as coupled or transmitted energy interactions, and circuit designs to respond to these electrical and/or magnetic energies are commonly implemented steady state and/or shaped waveform strategies. The interacting objects can be active (powered) or passive (un-powered) participants in the interaction.

An inductance sensing golf bag security system is known in which a programmable alarm is mounted to or built into an existing golf bag to protect against theft of the golf bag. With the inductance sensing system, a tag incorporating a ferromagnetic metal may be attached to the golf clubs to give the tag a high magnetic permeability. While such a golf bag security system can detect unauthorized removal of a golf club from a golf bag once the system is armed, it would be desirable to provide a golf club reminder system for golf bags that can alert the golf bag user to both absent-minded loss and theft of golf clubs, for any desired combination of golf clubs in the golf bag. The present invention satisfies these and other needs.

INVENTION SUMMARY

Briefly, and in general terms, in a first presently preferred embodiment, the invention provides for a golf club reminder system for golf bags based on capacitance-based, proximity sensing of golf clubs in a golf bag to automatically determine the total number of golf clubs present in a golf bag, and to automatically calibrate the proximity sensing system to any desired specific combination of golf clubs in the golf bag. A predetermined threshold value defines permissible load changes before an alert is announced, and the detector components are placed in the golf bag so that they do not interfere with normal golfing activities of the user, and so that no user interaction is required for operation of the golf club reminder system. The golf club reminder system for golf bags is a battery-powered device whose components and wiring are built into the seams, pockets, bottom cap, and top opening of a golf bag. The golf club reminder system is intended to operate in two modes. In a first normal mode the presence of a normal count of clubs in the golf bag is detected, and any absence of clubs or presence of additional clubs is silently indicated with a light. In a second security mode of operation an audio alert is also produced at the detection of any change in club count.

The first embodiment of the present invention accordingly provides for a golf club reminder system for a golf bag adapted to contain a set of golf clubs. The golf club reminder system is incorporated in a golf bag having an inside chamber for receiving the set of golf clubs, and includes means for sensing capacitance of material in the golf bag and for generating a sensed capacitance signal. The system also includes control means for determining whether a normal set of golf clubs is present in the golf bag based upon the sensed capacitance signal. A display is connected to the control means for displaying an indication of whether the normal set of golf clubs is present in the golf bag, and a user interface is connected to the control means for setting the control means for determining whether the normal set of golf clubs is present in the golf bag.

In a presently preferred aspect, the means for sensing capacitance of material in the golf bag and for generating a sensed capacitance signal includes first and second spaced apart electrodes mounted in the golf bag to provide for capacitive sensing of material between the first and second electrodes. The first and second electrodes serve as a transmission electrode and a sensor electrode, respectively, with the first electrode including a signal generator circuit for generating an electrical signal and an electronic transmit circuit for transmitting the electrical signal. In a presently preferred aspect, the signal generator circuit includes a ramp generator circuit for providing a constant volts/second signal. The first electrode is typically located inside the top opening of the golf bag. The second electrode includes an electronic sensor circuit for providing a voltage signal representing current from the second electrode, and in a presently preferred aspect, the electronic sensor circuit comprises a capacitance detection circuit and a linear op amp buffer. In another presently preferred aspect, the second electrode is shielded by ground foil connected to the second electrode. The second electrode is typically located at or near the bottom of the golf bag. The control means typically includes a microcontroller for controlling all electrical signal generation, signal detection, and for determining a change in the set of golf clubs in the golf bag.

In another presently preferred aspect, the golf club reminder system includes a sonic alarm, and the golf club reminder system has a first, non-security mode of operation, and a second, security mode of operation. In both modes of operation the golf club reminder system detects the presence of a normal count of golf clubs carried by the golf bag, and indicates on the display the insertion or removal of clubs by at least one light indicator, but in the second, security mode of operation, upon detecting the presence of a normal count of golf clubs carried by the golf bag, the golf club reminder system not only indicates the insertion or removal of clubs by at least one light indicator on the display, but additionally activates the sonic alarm.

The present invention also provides for a method for determining whether a normal set of golf clubs is present in a golf bag. The method involves providing a golf bag for containing a set of golf clubs, sensing capacitance of material in the golf bag and generating a sensed capacitance signal, determining whether the set of golf clubs in the golf bag is complete based upon the sensed capacitance signal, and displaying an indication of whether the normal set of golf clubs in the golf bag is complete. In a presently preferred aspect, the step of sensing capacitance of material in the golf bag and generating a sensed capacitance signal involves generating a constant volts/second signal, transmitting the constant volts/second signal from a first electrode, measuring current from a second electrode spaced apart from the first electrode, and generating a voltage signal representing current from the second electrode.

In a second embodiment, the invention provides for coupled electric-field sinusoidal AC waveform transmission and detection. This method is an electric-field loading type of detector. The detection is based on the shape of the waveform, frequency of the carrier wave, and types of filtering for extraneous electromagnetic noise. This method utilizes club conductivity instead of dielectric strength for conveyance of the sensing signal. Only one electric-field sensor is required near the clubs.

In a third embodiment, the invention provides for coupled magnetic-field sinusoidal AC waveform transmission and detection. This method is a magnetic-field loading type of detector. The detection is based on the shape of the waveform, frequency of the carrier wave, and types of filtering for extraneous electromagnetic noise. This method utilizes club magnetic properties instead of dielectric strength for conveyance of the sensing signal. Only one magnetic field sensing coil is required near the clubs.

In a fourth embodiment, the invention provides for transmitted electric-field sinusoidal AC waveform transmission and detection. This method is an electric-field transmission and reception type of detector similar to the current golf bag device. The primary difference is in the shape of the waveform, frequency of the carrier wave, and types of filtering for extraneous electromagnetic noise. This method utilizes club conductivity instead of dielectric strength for conveyance of the sensing signal. Two or more electrodes near the clubs are required for operation.

In a fifth embodiment, the invention provides for transmitted magnetic-field sinusoidal AC waveform transmission and detection. This method is a magnetic-field transmission and reception type of detector similar to the current golf bag device. The primary difference is in the shape of the waveform, frequency of the carrier wave, and types of filtering for extraneous electromagnetic noise. This method utilizes club magnetic properties instead of dielectric strength for conveyance of the sensing signal. Two or more electrodes near the clubs are required for operation.

In a sixth embodiment, the invention provides for transmitted optical signal detection. This method utilizes a light source (visible, IR, UV) transmission and reception type of detector. This method utilizes club optical properties for blocking the sensed signal. A transmit and receive pair of optical devices is required for each club.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
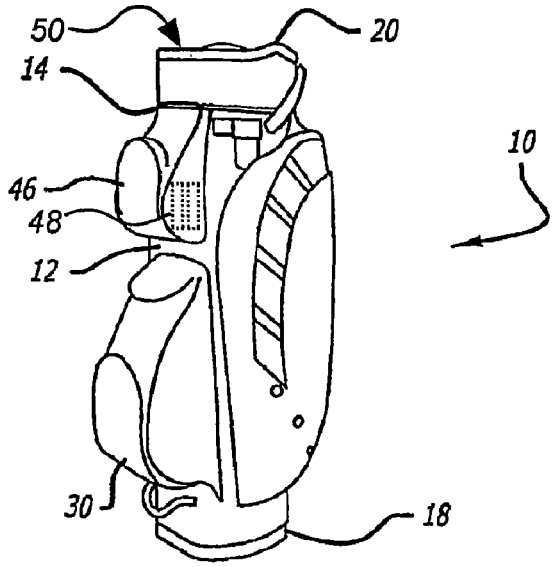
FIG. 1 is an illustration of a golf bag incorporating the golf club reminder system, according to the present invention.
Figure 2:
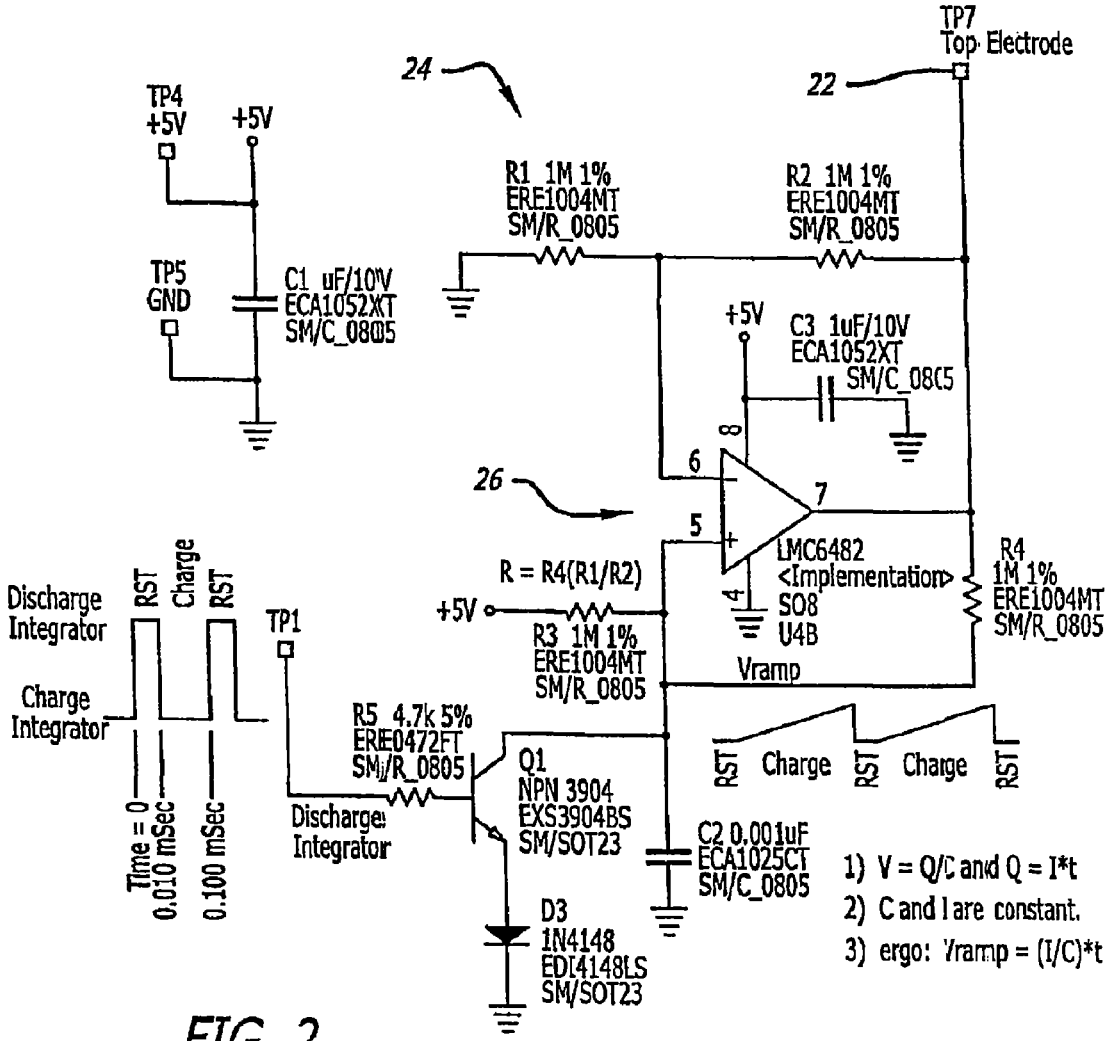
FIG. 2 is a schematic diagram of a first electrode and electronic transmit circuit of the golf club reminder system of the present invention.
Figure 3:
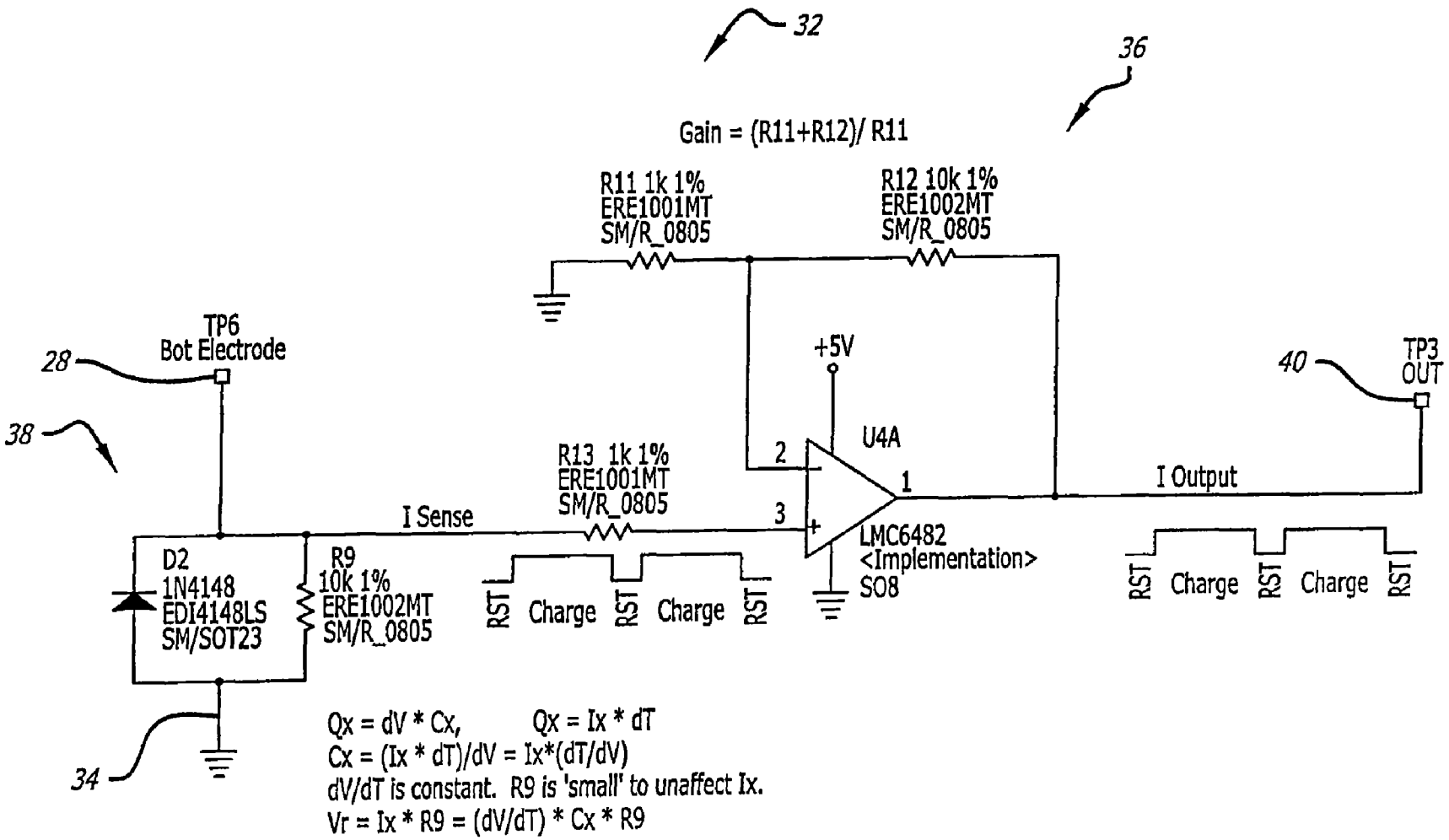
FIG. 3 is a schematic diagram of a second electrode and electronic sensor circuit of the golf club reminder system of the present invention.
Figure 4:
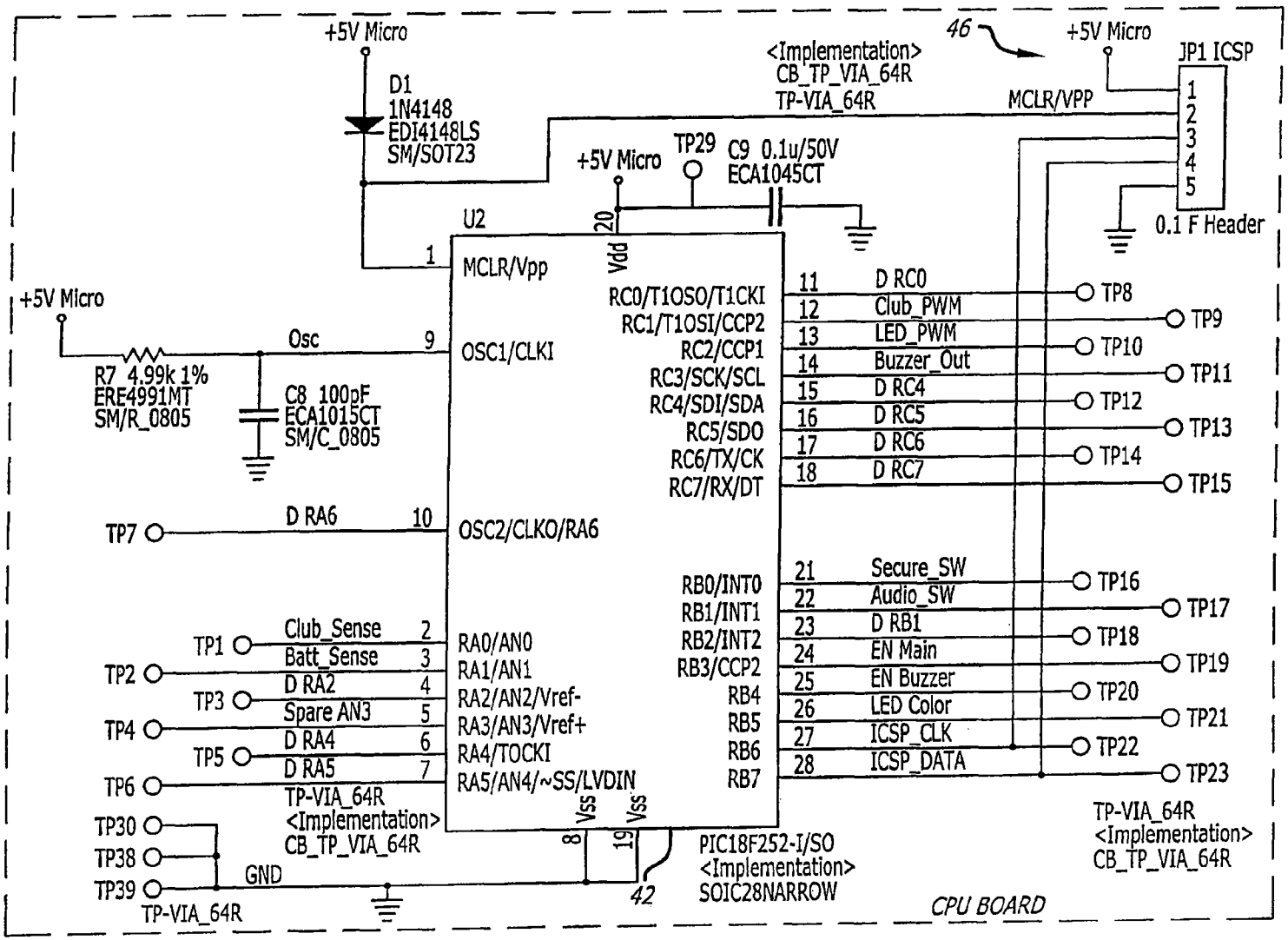
FIG. 4 is a schematic diagram of the microcontroller of the golf club reminder system of the present invention.
Figure 5:
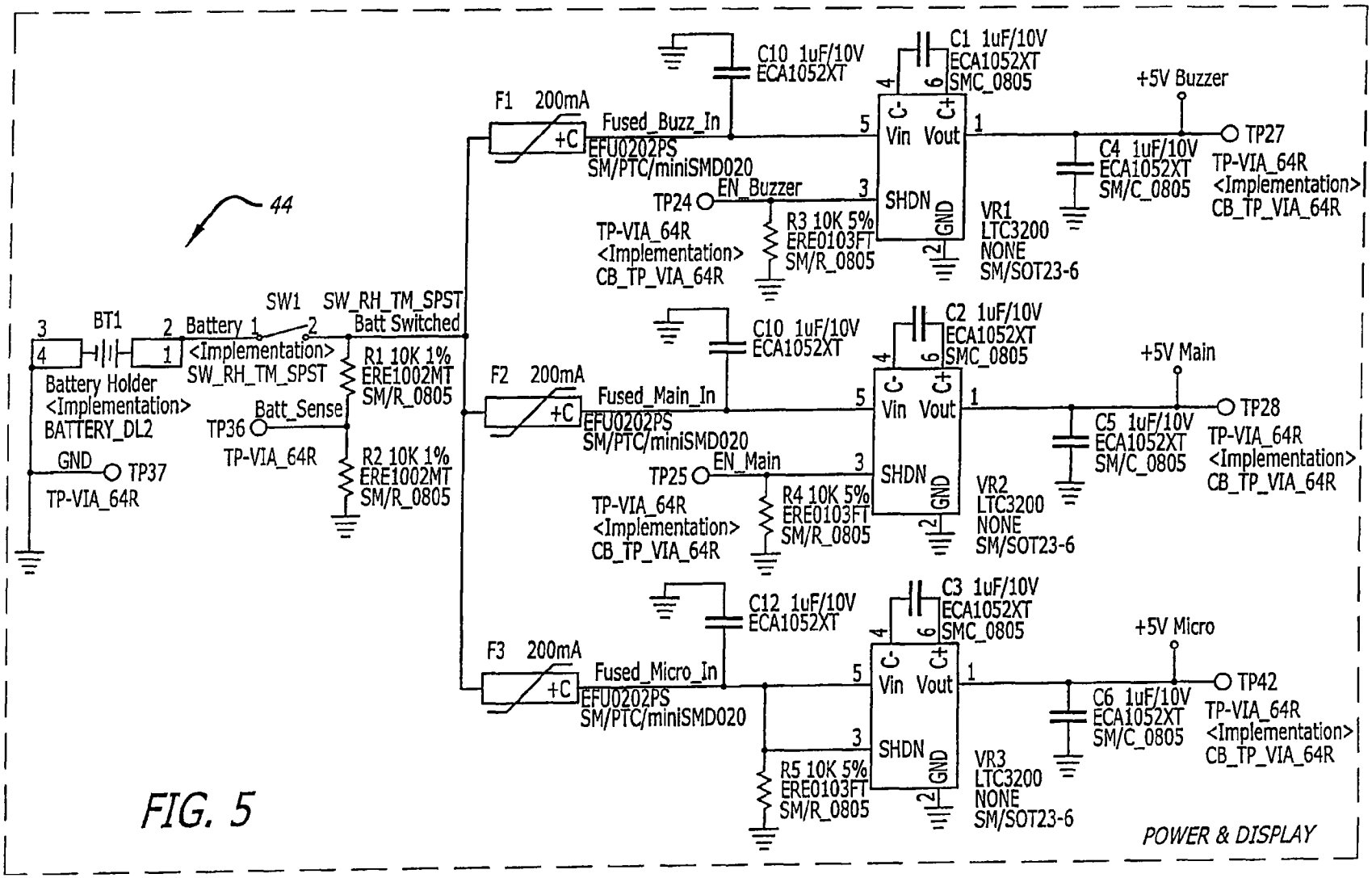
FIG. 5 is a schematic diagram of the power supply for the alarm, microcontroller and display of the golf club reminder system of the present invention.
Figure 6:
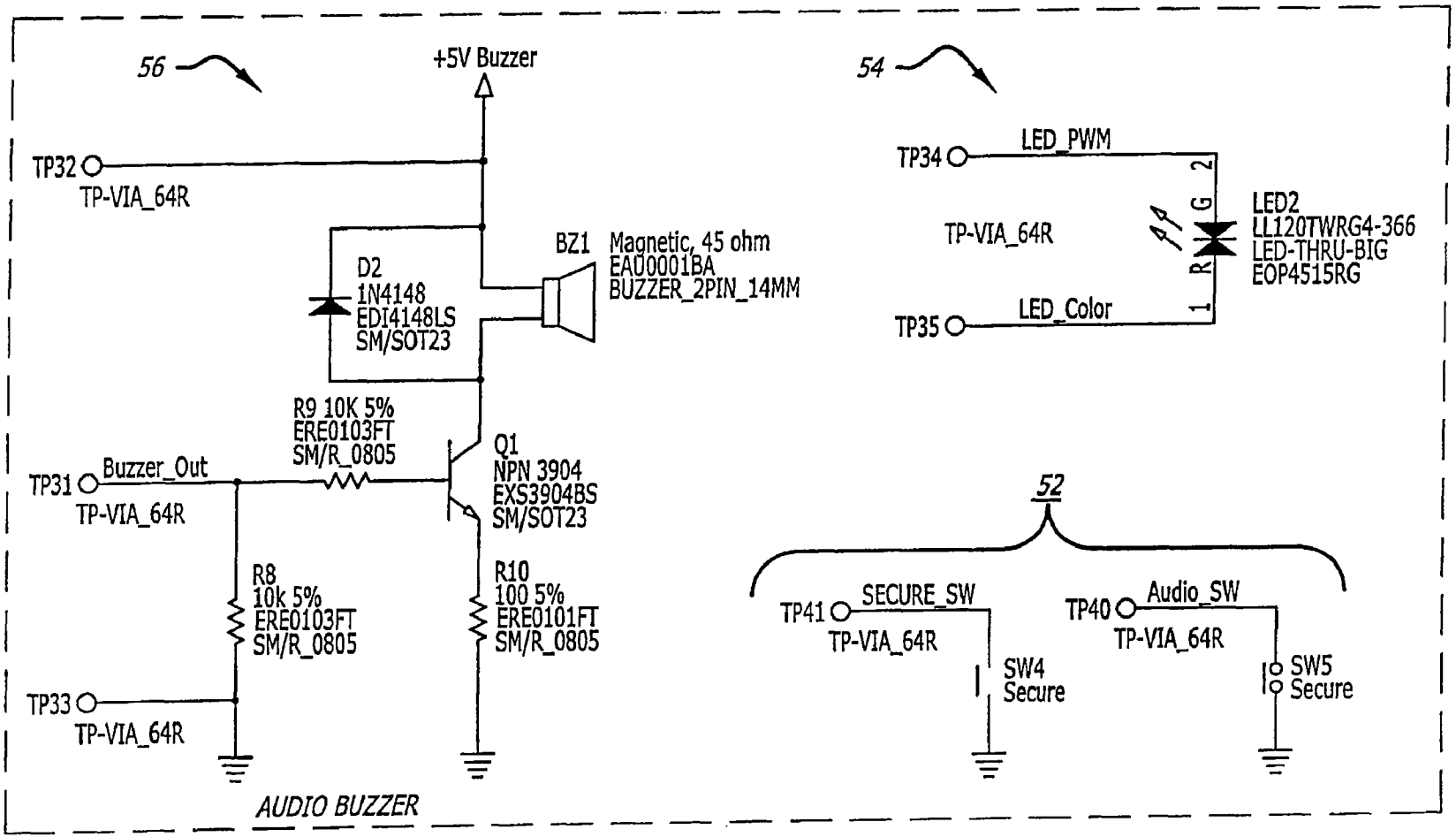
FIG. 6 is a schematic diagram of the alarm circuit, display LED alert, and button panel user interface of the golf club reminder system of the present invention.

Referring to the drawings, which are provided for purposes of illustration and by way of example, the present invention provides for a golf club reminder system for golf bags. Referring to FIG. 1, the a golf club reminder system of the present invention includes battery-powered components and wiring that are built into a golf bag 10, having a body 12 with seams 14, pockets, a bottom cap 18, and a top opening or mouth 20.

A first metal electrode 22, the "transmit" electrode, is typically located at the inside of the top opening of the golf bag. The first electrode is connected to an electronic transmit circuit 24 and a signal generator circuit 26, typically a ramp generator circuit, such as a Deboo integrator with Howland constant current source, for example, to provide the constant volts/second signal to the top electrode in the bag.

A second metal electrode 28, the "sensor" electrode, is located at or near the bottom of the golf bag, typically in a bottom electrode pouch 30. The second electrode is connected to an electronic sensor circuit 32, and is currently preferably shielded by ground foil 34 connected to the bottom electrode. The electronic sensor circuit includes a capacitance detection circuit 36, and a linear op amp buffer 38. The capacitance detection circuit is configured as a current detector using resistance drop to provide a measured voltage signal 40 representing the current from the bottom electrode.

The first and second metal electrodes are typically located relatively far apart to provide for capacitive sensing of material between the first and second metal electrodes, with golf clubs (not shown) in the golf bag, and the golf bag acting as the dielectric material between the two electrodes. The electrodes and the golf bag material have a small, measurable air gap capacitance when used alone, without golf clubs in the golf bag. The physical location and the capacitance relationship between the electrodes and the golf bag material does not change. The golf clubs within the golf bag provide the variable dielectric material between the electrodes to increase/decrease capacitance at a measurable level. This is the variable condition directly controlling the capacitance that is measured. Other configurations for capacitive sensing of golf clubs in the golf club may include additional electrodes placed further toward the middle of the golf bag, or an alternative placement of the first and second electrodes, such as at intermediate opposition locations elsewhere in the golf bag, for example.

The voltage signal from the electronic sensor circuit is measured by an analog to digital converter circuit (ADC) provided in the microcontroller 42, such as a PIC18F252 microcontroller, for example. The microcontroller device is used to control all electrical signal generation, signal detection, and the analysis of change in the number of clubs present. The microcontroller also computes timing of user inputs, such as user operable switches, controls status outputs, such as lights and a buzzer, and monitors battery power running time, such as for automatic shutoff. The microcontroller may be located, for example, in a pouch 46 inside the golf bag. The microcontroller is connected to one or more batteries 48, such as AA batteries, for example, which may be located in the pouch with the microcontroller, for powering the golf club reminder system.

The microcontroller is also connected to a display 50, typically located near the top opening of the golf bag, which may include a button panel user interface 52. The user interface typically includes an LED 54 indicating the status of whether the first normal mode of operation of the golf club reminder system is ON or OFF, and whether the second security mode of operation is armed. The display is preferably moisture proof, and should be bright enough to be readable in the full outdoor sun. The display typically includes an LED for indicating the states of 'bag full'/'club missing' and preferably includes a push button for resetting the sensor of the golf club reminder system. The display may also include one or more LEDs to display environmental problems such as presence of moisture, or whether the temperature is too high or too low, as well as hardware failure problems, and battery level. The display also preferably includes one or more LEDs to display security alerts, such as club tampering, removal, insertion, exchange, or shift in club position. Motion of the golf bag and tampering can be detected by incorporating an accelerometer in the golf club reminder system. The microcontroller is also connected for operation of a security sonic alert 56, such as an alarm or buzzer. Wiring or cabling connecting the microcontroller with the various components of the golf club reminder system, particularly with the bottom electrode, the top electrode, the display, the sonic alert, and the batteries, is preferably hidden from the user.

The golf bag may include compartments providing access to components of the golf club reminder system, with flaps to protect or hide components of the golf club reminder system. Such flaps may be fitted with various kinds of fasteners as desired, such as hook and loop fasteners, snaps, buttons, zippers and the like. The electrodes and electronics of the golf club reminder system should also be protected from dirt, dust, and contaminants, impacts and abrasions, extreme temperatures and sun, and are typically protected and insulated by padding in the compartments, and the flaps of the compartments of the golf bag. The compartments housing the components of the golf club reminder system may alternatively include a plastic shell to house the components. The golf club reminder system may also include a sonic alert to signal when tampering with the golf bag or golf clubs in the golf bag is detected. Such a sonic alert system typically requires a high current draw, as the sonic alert should be loud enough to compensate for whatever level of outdoor noise competition and distance to the user may be involved, and may have an adjustable duration, volume, frequency range, and tone, such as a warble, siren, or alarm bursts.

The golf club reminder system typically has a first, non-security mode of operation, and a second, security mode of operation. In the first, non-security mode of operation the golf club reminder system detects the presence of a normal count of clubs (typically 14) carried by the golf bag, and silently indicates the insertion or removal of clubs by one or more light indicators. In the second, security mode of operation, the golf club reminder system carries out these same functions, and will additionally produce a loud audio security alert upon the detection of any change in club count. In both modes of operation, the golf club reminder system automatically determines the total capacitance of the material that is present between the two electrodes in the golf bag, corresponding to the total number of clubs in the golf bag. In this manner, the present invention provides a method for calibrating the golf club reminder system to any specific combination of clubs to be retained in the golf bag. A pre-computed threshold value defines permissible load changes before an alert is announced.

The method to measure the capacitance in our product is based on the relationship between capacitance, charge, voltage, current, and time. The relationship between stored charge (Sc), capacitance (C), and voltage (V) can be expressed as shown in Equation 1 below:

$$Sc = C \times V \qquad \text{Eq. 1}$$

The relationship between stored charge (Sc), time (T) and current (I) can be expressed in the following equation:

$$I = Sc/Time \qquad \text{Eq. 2}$$

Substitution for stored charge (Sc) in Eq. 2 yields the following equation:

$$I = (C \times V)/T \qquad \text{Eq. 3}$$

Rearranging the Eq. 3 shows the relationship in a different form that supports a strategy for circuit implementation, according to the following equation:

$$I = C \times (V/T) \qquad \text{Eq. 4}$$

The present invention accordingly provides for a method generating a known time varying voltage signal to one of the electrodes and measuring the current into or out of the other electrode. A specific signal presented to one electrode that has a constant voltage change in time (V/T) will result in a constant current in the other electrode that is only variable with respect to the capacitance of the electrode-club circuit.

The dielectric value of golf clubs in a golf bag can be detected and measured without electrical contact. The usual methods to do this are all related to the effect that the dielectric material has on increasing the capacitance value when used in the construction of a capacitor device. Where $C_F$ is the final capacitance, the basic formula to relate dielectric materials to capacitance effect is:

$$C_F = G_{AC} \times D_V \quad \text{Eq. 5}$$

By substitution for capacitance in Eq. 4 above, where $G_{AC}$ is air gap capacitance, and $D_V$ is dielectric value, the relationship becomes:

$$I = (G_{AC} \times D_V) \times (V/T) \quad \text{Eq. 6}$$

Since the air gap capacitance is held constant and (V/T) is held constant, the only variable that controls the electrode current is the dielectric value of the club material in the bag. The device's operation is based on the principle that all materials have an inherent, unique dielectric constant. It is not necessary to know the specific value of the dielectric constant for the materials present. It is only necessary that there be enough material present so that the total dielectric value is within the detection range of the measurement circuitry. Testing has shown that this is the normal condition when any combination of steel or carbon fiber golf clubs are used as the objects to be detected in a golf bag.

Figure 7:
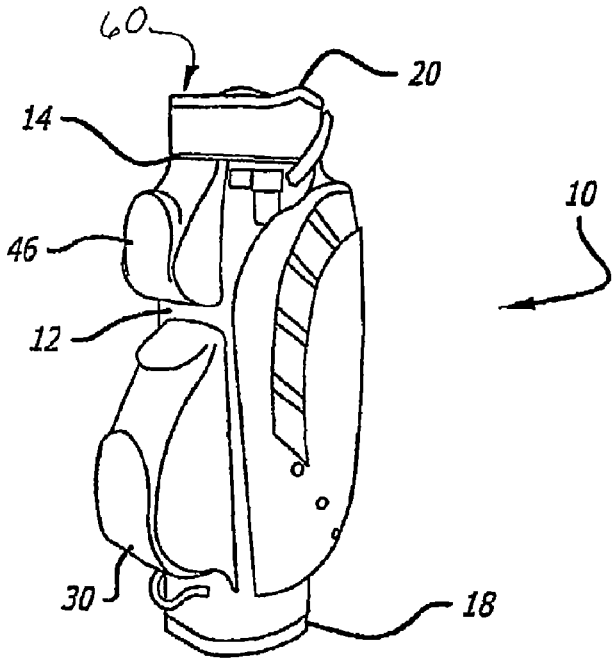
FIG. 7 is an illustration of a golf bag incorporating the golf club reminder system, showing the general location of a single electric or magnetic field sensor in the top opening or mouth of the golf bag near clubs to be placed in the golf bag, according to the present invention.

Referring to FIG. 7, a single sensor may be placed near clubs in the golf bag of FIG. 1, such as in the top opening or mouth of the golf bag at 60, for example. In a second embodiment, the single sensor may be an electric-field loading type of detector that is capable of providing coupled electric-field sinusoidal AC waveform transmission and detection, such as a Fabry-Perot interferometer sensitive to electric fields, for example. The detection is based on the shape of the waveform, frequency of the carrier wave, and types of filtering for extraneous electromagnetic noise. This method utilizes club conductivity instead of dielectric strength for conveyance of the sensing signal. Only one electric-field sensor is required near the clubs. Alternatively, in a third embodiment, the single sensor in the top opening or mouth of the golf bag at 60, for example, may be a magnetic-field loading type of detector that is capable of providing coupled magnetic-field sinusoidal AC waveform transmission and detection, such as a magnetic field sensor that uses a Hall effect transducer, such as is available from Vernier, for example, or a magnetometer available from Honeywell, for example. The detection is based on the shape of the waveform, frequency of the carrier wave, and types of filtering for extraneous electromagnetic noise. This method utilizes club magnetic properties instead of dielectric strength for conveyance of the sensing signal. Only one magnetic field detector is required near the clubs.

Figure 8:
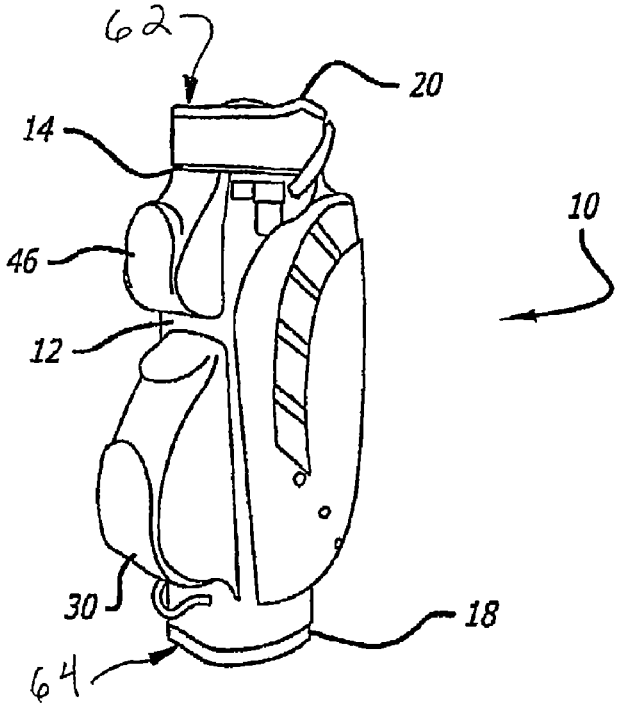
FIG. 8 is an illustration of a golf bag incorporating the golf club reminder system, showing the general locations of two or more electric or magnetic field sensors in the top opening or mouth of the golf bag, and in the bottom of the golf bag, near clubs to be placed in the golf bag, according to the present invention.
Figure 9:
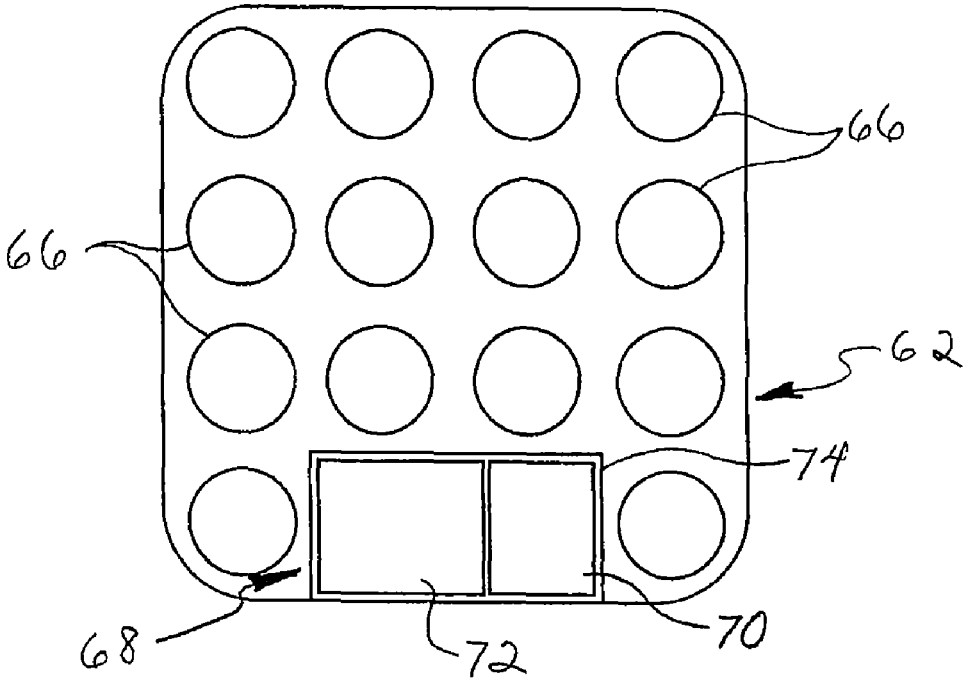
FIG. 9 is a schematic diagram of a top opening or mouth of a golf bag, showing placement of an upper electric or magnetic field sensor and a control unit in the top opening or mouth of the golf bag, according to the present invention.

Referring to FIG. 8, the detector may include two or more spaced apart electrodes which may be placed near clubs in the golf bag of FIG. 1, such as in the top opening or mouth of the golf bag at 62, for example, and such as at the bottom of the golf bag at 64, for example. As is illustrated in FIG. 9, the golf bag typically includes a plurality of golf club tubes 66, and may include a control unit 68 operatively connected to an electrode in the top opening or mouth of the golf bag 62 for determining whether the set of golf clubs in the golf bag is complete based upon signals from the detector. The control unit may include a control keypad 70 for setting the control unit for determining whether the set of golf clubs in the golf bag is complete, and a display 72 connected to the control unit for displaying an indication whether the set of golf clubs in the golf bag is complete. In a fourth embodiment, the two or more electrodes may form an electric-field transmission and reception type of detector that provides for transmitted electric-field sinusoidal AC waveform transmission and detection, and one or more of the electrodes 74 may be included in or placed adjacent to the control unit, for example. The primary difference between this approach and the detector of the first embodiment is in the shape of the waveform, frequency of the carrier wave, and types of filtering for extraneous electromagnetic noise. This method utilizes club conductivity instead of dielectric strength for conveyance of the sensing signal. Two or more electrodes near the clubs are required for operation. Alternatively, in a fifth embodiment, the two or more electrodes may form a magnetic-field transmission and reception type of detector that provides for transmitted magnetic-field sinusoidal AC waveform transmission and detection. The primary difference between this approach and the detector of the first embodiment is in the shape of the waveform, frequency of the carrier wave, and types of filtering for extraneous electromagnetic noise. This method utilizes club magnetic properties instead of dielectric strength for conveyance of the sensing signal. Two or more electrodes near the clubs are required for operation.

Figure 10:
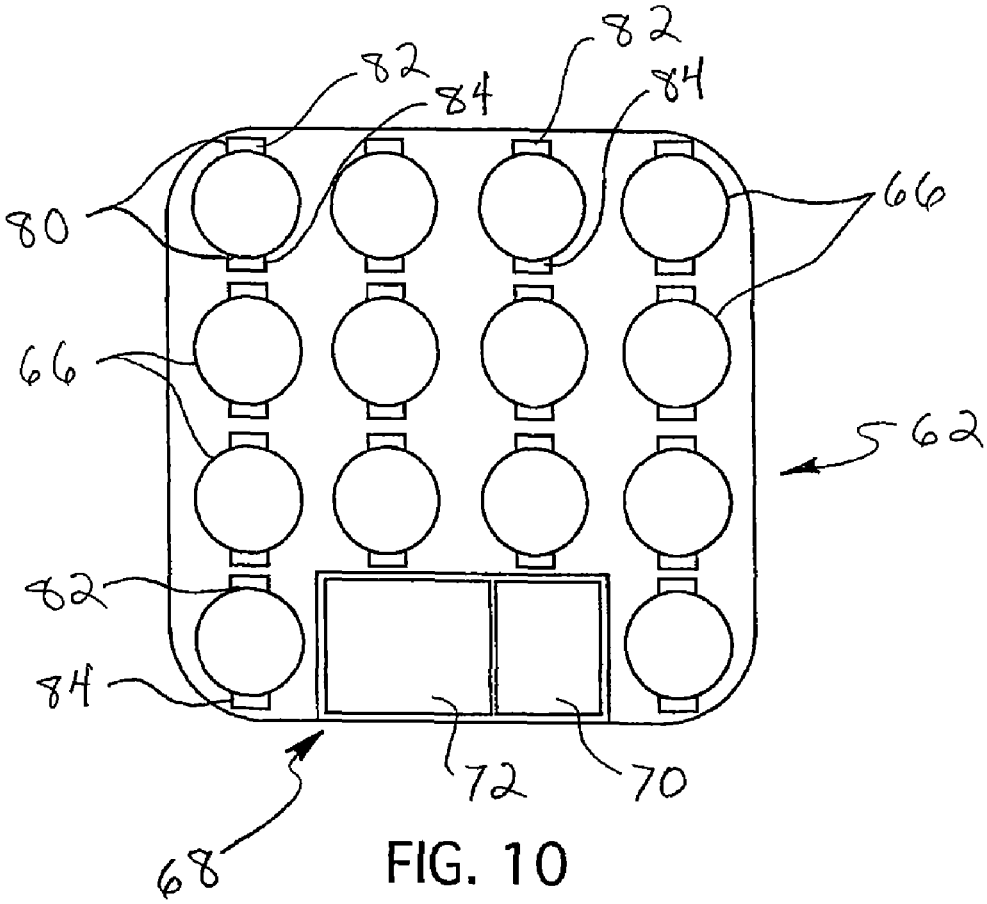
FIG. 10 is a schematic diagram of a top opening or mouth of a golf bag, showing placement of multiple pairs of optical signal transmitters and receivers and a control unit in the top opening or mouth of the golf bag, according to the present invention.

Referring to FIG. 10, in a sixth embodiment, the invention provides for transmitted optical signal detection, using a transmission and reception type of detector, which may be formed from a plurality of pairs 80 of a transmitter 82 and a corresponding receiver 84 of an optical signal, typically mounted to golf club tubes 66, for example. Each transmitter is preferably a controlled light source, emitting visible, IR, UV light, which the receivers are capable of measuring, for example, and each of the pairs of transmitters and receivers are typically operatively connected to the control unit 68 in the top opening or mouth of the golf bag 62. Based on signals from the pairs of transmitters and receivers, the control unit 68 determines whether the set of golf clubs in the golf bag is complete. The control unit may include a control keypad 70 for setting the control unit for determining whether the set of golf clubs in the golf bag is complete, and a display 72 connected to the control unit for displaying an indication whether the set of golf clubs in the golf bag is complete. This method utilizes club optical properties for blocking the sensed signal. A transmit and receive pair of optical devices is required for each club.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. A golf club reminder system, comprising:

a golf bag having an inside chamber for receiving a set of golf clubs, a top opening, and a bottom;

a golf club detector mounted to said golf bag, said golf club detector being configured to generate a sinusoidal AC waveform golf club detection signal indicating a presence or absence of the set of golf clubs in the golf bag;

a controller mounted to said golf bag, said controller being configured to determine the presence or absence of the set of golf clubs in the golf bag based upon said golf club detection signal; and a display connected to the control means for displaying an indication of the presence or absence of the set of golf clubs in the golf bag.

2. The golf club reminder system of claim 1, wherein said golf club detector comprises an electric-field loading detector.

3. The golf club reminder system of claim 1, wherein said golf club detector comprises a magnetic-field loading detector.

4. The golf club reminder system of claim 2, wherein said electric-field loading detector comprises a plurality of spaced apart electrodes.

5. The golf club reminder system of claim 3, wherein said magnetic-field loading detector comprises a plurality of spaced apart electrodes.

6. The golf club reminder system of claim 1, wherein said golf club detector mounted at the top opening of the golf bag.

7. The golf club reminder system of claim 1, wherein said controller is mounted near the top opening of said golf bag.

8. The golf club reminder system of claim 1, wherein said display is located near the top opening of said golf bag.

9. A golf club reminder system, comprising:

a golf bag having an inside chamber for receiving a set of golf clubs, a top opening, and a bottom;

an optical golf club detector mounted to said golf bag, said optical golf club detector being configured to generate a golf club detection signal indicating a presence or absence of the set of golf clubs in the golf bag;

a controller configured to determine the presence or absence of the set of golf clubs in the golf bag based upon said golf club detection signal; and a display connected to the control means for displaying an indication of the presence or absence of the complete set of golf clubs in the golf bag.

10. The golf club reminder system of claim 9, wherein said optical golf club detector comprises a plurality of optical signal transmitter and corresponding receiver pairs.

11. The golf club reminder system of claim 10, wherein said golf bag comprises a plurality of golf club tubes and each of said optical signal transmitter and corresponding receiver pairs is mounted to one of said golf club tubes for detecting golf clubs in said golf club tubes.

12. The golf club reminder system of claim 9, wherein said optical golf club detector is mounted at the top opening of said golf bag.

13. The golf club reminder system of claim 9, wherein said controller is mounted near the top opening of said golf bag.

14. The golf club reminder system of claim 9, wherein said display is located near the top opening of said golf bag.

* * * * *